US005690061A

United States Patent [19]

Lopez

[11] Patent Number: 5,690,061

[45] Date of Patent: Nov. 25, 1997

[54] WATER HEATER WITH EXPANSION TANK

[76] Inventor: Juan A. Lopez, 120 King Arthur Ct., Fayetteville, Ga. 30214

[21] Appl. No.: 613,760

[22] Filed: Feb. 26, 1996

[51] Int. Cl.[6] ..... F22B 5/00

[52] U.S. Cl. ..... 122/17; 122/13.1; 126/361

[58] Field of Search ..... 126/361, 362; 122/13.1, 17, 19

[56] References Cited

U.S. PATENT DOCUMENTS 1,338,760 5/1920 Wells ..... 126/361

5,027,749 7/1991 Cifaldi ..... 126/361

*Primary Examiner*—Carroll B. Dority

*Attorney, Agent, or Firm*—James B. Middleton

[57] ABSTRACT

A hot water heater has an expansion tank below the water tank and aligned with the water tank, so both water tank and expansion tank occupy the same floor space. The expansion tank is connected to the water tank by a pipe, so expansion due to heating of the water is absorbed by the expansion tank. For gas fired heaters, the burner for heating water in the water tank is disposed above the expansion tank and below the water tank, so the burner is above the floor sufficiently to comply with gas safety regulations.

6 Claims, 1 Drawing Sheet

WATER HEATER WITH EXPANSION TANK

BACKGROUND OF THE INVENTION

1. Field of the Invention

This invention relates generally to water heaters and the like, and is more particularly concerned with a water heater having an integral expansion chamber and elevated burner assembly.

2. Discussion of the Prior Art

The conventional gas fired hot water heater comprises a cylindrical tank having a heating means at the lower end thereof. Fro gas fired tanks, a flue extends through the tank from the bottom, to a vent pipe at the upper end of the tank. While such hot water heaters have been used successfully for many years, additional regulations recently instituted have rendered the conventional hot water heater difficult to install properly.

One recent change is in the installation of check valves at the water meter for each residence. It will be understood that, when water is heated, it expands. When a tank is full of water and the water expands the tank might yield, except that the tank is kept full only by the incoming water pressure. Thus, the water could normally expand into the incoming water line. However, when a check valve is placed in the incoming water line, the usual expansion is no longer possible. The next likely area for expansion is the outgoing water line. This of course leads into the residence piping system. Unless a faucet or the like just happens to be open, the expanding water will rupture whatever is the weakest point in the system, which is very likely the pressure relief valve. The relief valve generally drains water to the outside, or down a drain. Otherwise, the weak point may be a faucet washer, or it may be a washing machine hose, or even a weak pipe. Something will yield to accommodate the expanding water.

To solve the problem of the expanding water, expansion tanks have been used. Such tanks have been difficult to install because there is simply no room for an additional tank. Water heaters are typically placed in as small quarters as possible, rendering it difficult indeed to install yet another tank in the same space.

Another problem with gas fired hot water heaters is that they constitute a combustion hazard. When a water heater is installed in a garage, storage house or the like, it is now required that the burner be elevated from the floor. Many flammable solvents and the like have vapors that are heavier than air. As a result, when such vapors escape, they linger at floor level where the burner may ignite the vapors. By requiring the burner to be elevated, therefore, the installation is much less of a fire hazard.

In order to raise the burner of a hot water heater, one usually raises the entire hot water heater. This of course requires considerable re-piping of the gas, water, and the flue, so customers frequently object to the cost of proper installation of a hot water heater.

SUMMARY OF THE INVENTION

The present invention provides a hot water heater having an expansion tank at the bottom thereof, with the usual water tank above the expansion tank. The gas burner is above the expansion tank and at the lower end of the hot water tank. A pipe line connects the interior of the water tank with the interior of the expansion tank. Since the burner is above the expansion tank, the burner is positioned the required distance from the floor; and, since the expansion tank is directly below the hot water tank, the same floor space is utilized for both the water tank and the expansion tank.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
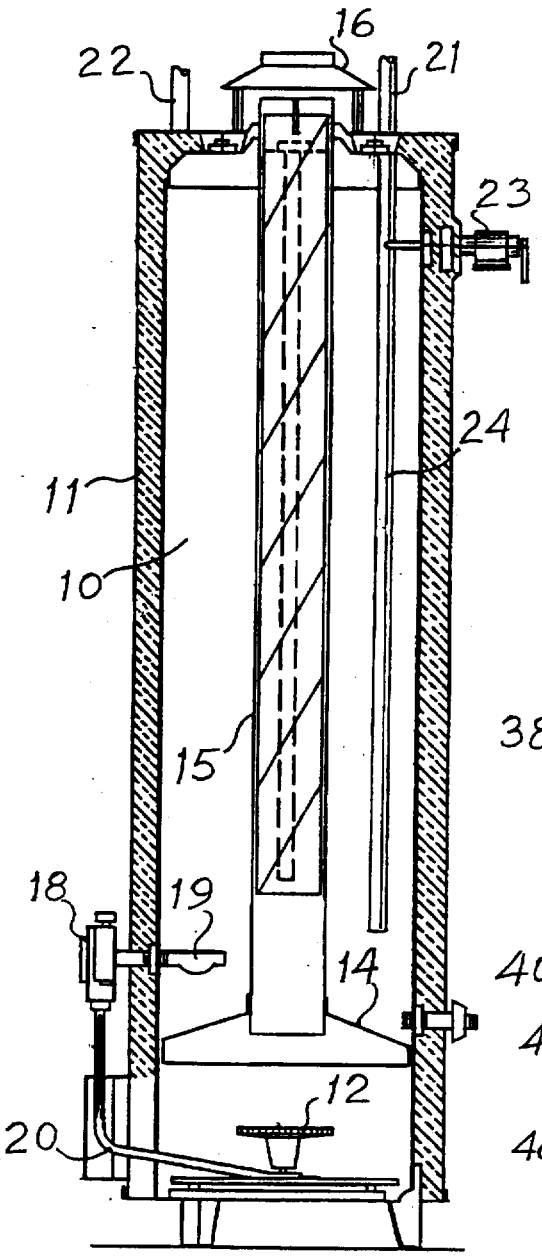
Fig.1 PRIOR ART
FIG. 1 is a diametrical cross-sectional view taken through a conventional gas fired hot water heater; and, FIG. 2 is a diametrical cross-sectional view of a gas fired hot water heater with expansion tank made in accordance with the present invention.

Referring now more particularly to the drawings and to that embodiment of the invention here presented by way of illustration, FIG. 1 shows a conventional, prior art, water heater which includes a hot water tank 10 having an insulation jacket 11 therearound. Below the tank 10 is a gas burner 12. The hot combustion products from the burner 12 are collected by the hood 14 and directed through the flue pipe 15. Those skilled in the art will understand that the flue pipe 15 may have various baffles or the like to slow the passage of flue gases to allow more heat absorption as the flue gases pass to the vent pipe 16.

There is a thermostatic control device indicated at 18, the control device including a sensing element 19 for sensing the temperature of the water in the tank 10, and a gas line 20 to feed gas to the burner 12 as determined by the control device 18.

At the top of the tank 10, there are water inlet and outlet pipes 21 and 22. The inlet pipe usually includes a pipe 24 inside the tank 10 to direct incoming water to the bottom area of the tank 10, while the outlet pipe usually receives water from the top area of the tank. It will be understood that the incoming cold water will sink to the bottom of the tank, but conducting the cold water via the pipe 24 prevents intermingling of the cold water with hot water. Hot water will of course rise to the top of the tank 10, so the hot water will be discharged through the outlet pipe 22.

Considering the water heater shown in FIG. 1 of the drawings and described above, it will be seen that, when the cold water enters the tank 10 and is heated, the only place the water can flow to allow for expansion is into the inlet and outlet pies 21 and 22. If the water expands through the inlet pipe 21, water will be flowing back to the municipal water supply. While this has been allowed in the past, it is now common to have a check valve at the water meter so such expansion is no longer possible. Thus, the water will expand either through the pressure relief valve 23, or through the outlet pipe 22, which leads to the residential piping. The increased pressure will cause flow wherever possible, and this may be by rupturing a faucet washer, or a washing machine hose, or a weak pipe.

It will further be noticed that the burner 12 is situated very low in the apparatus shown in FIG. 1. Because of this fact, if a combustible vapor is in the vicinity of the apparatus, the gas burner 12, or the pilot light (not shown) will ignite the vapor.

Figure 2:
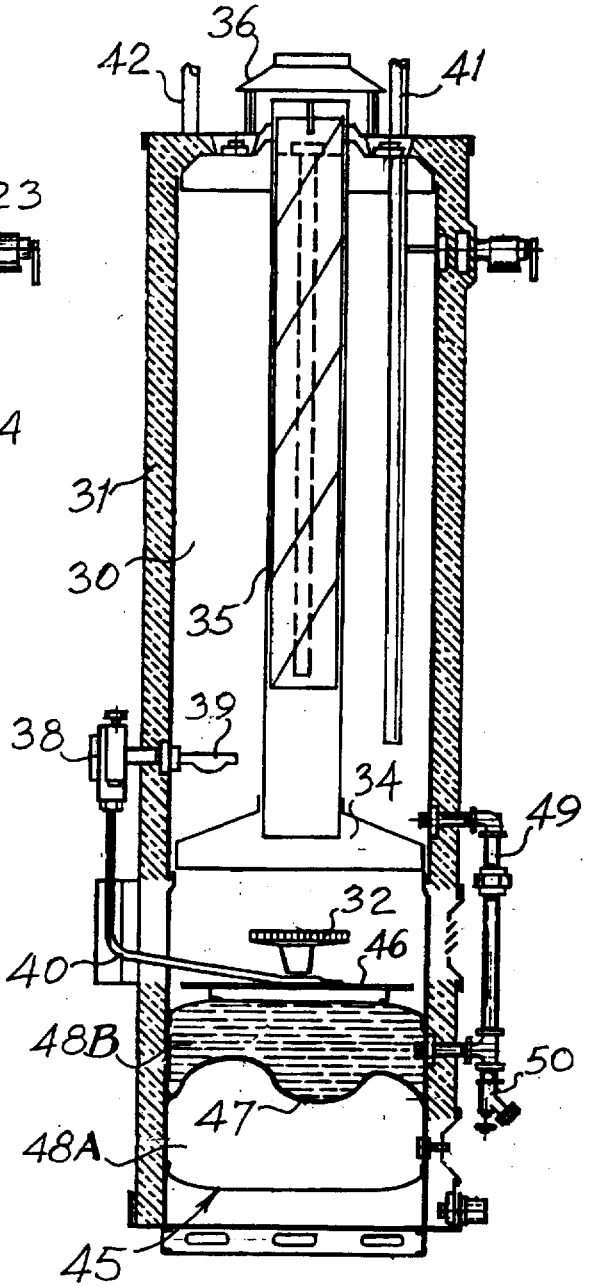

Turning then to the water heater shown in FIG. 2 of the drawings, it will be noticed that the upper portion of the apparatus is the same as that shown in FIG. 1. There is a water tank 30 surrounded by insulation 31. Inlet and outlet pipes 41 and 42 connect to the tank 30 at the top. A flue pipe 35 extends up the center of the tank 30, and connects to the vent pipe 36. The apparatus shown in FIG. 2 also includes a burner 32 below the tank 30, the burner 32 being fed by a gas line 40 which extends from a control device 38. All these features are the same in FIG. 1 and FIG. 2, and the detailed description does not need to be repeated.

In the apparatus shown in FIG. 2 of the drawings, there is an expansion tank 45 below the burner 32. The expansion tank 45 is below the tank 30 and is aligned therewith, so the tank of FIG. 2 has the same lateral dimensions as the tank of FIG. 1. The expansion tank 45 has a platform 46 fixed thereto for supporting the burner 32, so the burner 32 is well above the floor or other supporting surface for the water heater.

Those skilled in the art will understand that many different mechanical arrangements may be utilized for the expansion tank 45; but, the tank 45 here shown is one that is commercially available and works well. The tank 45 includes a diaphragm 47 that divides the tank into two portions. The lower portion 48A is charged with air, while the upper portion 48B may receive water therein. The air pressure in portion 48A is sufficient that water will not normally flow into the portion 48B; however, when the water pressure increases, e.g. due to heating, water will flow into the portion 48B, compressing the air in the portion 48A.

Those skilled in the art will realize that the expansion tank 45 is only one possible arrangement. The air may be on top as is well known in water-pressure systems, with water in the bottom. The system shown works well in many systems, and is preferred type of tank.

Looking at the lower right side of FIG. 2, it will be noticed that a pipe 49 connects the interior volume of the tank 30 with the interior volume of the upper portion 48B of the expansion tank 45. The pipe 49 includes a valve 50 for selectively draining the tanks.

With the apparatus arranged as shown, it will be recognized that the hot water heater can be connected to residential plumbing as is usual, so the tank 30 will fill with water while air escapes through the outlet 42. Obviously, a faucet must be left open until the tank 30 has filled. The tank 30 will now be filled with cold water.

With the tank is filled, the burner 32 will be lit, and the water will be heated. As the water heats, it will expand. As the pressure of the heated water rises, the pressure will be exerted through the pipe 49 and into the expansion tank 45. The pressure will increase until the resistance of the diaphragm 47 and the air pressure are overcome, and the bottom 48 will expand, thereby increasing the volume of the upper portion 48B. The expansion will continue until the water has reached its maximum temperature.

At the same time, it will be recognized that the burner 32 is well above the floor or other support surface for the water heater. It is contemplated that the expansion tank 45 will be designed to support the burner 32 above the support surface sufficiently to conform to regulations. As a result, no additional platform, or riser will be required to install a hot water heater.

It will therefore be understood that the present invention provides a hot water heater having a built-in expansion tank so that no separate installation of an expansion tank is required. The expansion tank is placed below the heating means for the hot water heater, so the gas burner or the like is elevated above the support surface as is required by safety regulation. The basic, simple installation of the hot water heater is therefore in conformity with safety regulations. No additional risers or the like are required.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A hot water heater comprising a water tank for receiving a quantity of water, heating means for heating said water tank and said quantity of water therein, an inlet pipe for supplying water to said water tank and an outlet pipe for discharging water from said water tank, an expansion tank disposed beneath said water tank, movable means in said expansion tank separating said tank into an air compartment and a water compartment, and pipe means for connecting the interior of said water tank with the water compartment of said expansion tank so that, when said quantity of water in said water tank is heated by said heating means, the expanded volume can flow through said pipe means into said expansion tank.

2. A hot water heater as claimed in claim 1, wherein said movable means includes a diaphragm dividing said expansion tank into an upper portion forming said water compartment and a lower portion, forming said air compartment.

3. A hot water heater as claimed in claim 2, wherein said heating means comprises a burner, said burner being disposed above said expansion tank and below said water tank.

4. A hot water heater as claimed in claim 1, wherein said heating means comprises a burner, said burner being disposed above said expansion tank and below said water tank.

5. A hot water heater as claimed in claim 3, wherein said burner consists of a gas burner.

6. A hot water heater as claimed in claim 5, wherein said water tank and said expansion tank are aligned so that said hot water heater and said expansion tank occupy the same floor space.

* * * * *